US008579721B1

(12) United States Patent
Taylor

(10) Patent No.: US 8,579,721 B1
(45) Date of Patent: Nov. 12, 2013

(54) CLEAN-BURN VORTEX GENERATOR FOR A BALLISTIC IMPELLER GOLF CLUB

(76) Inventor: Roy H. Taylor, Byhalia, MS (US)

( * ) Notice: Subject to any disclaimer, the term of this patent is extended or adjusted under 35 U.S.C. 154(b) by 108 days.

(21) Appl. No.: 12/006,175

(22) Filed: Dec. 31, 2007

(51) Int. Cl.
*A63B 53/00* (2006.01)

(52) U.S. Cl.
USPC ..... 473/282; 473/131; 473/329

(58) Field of Classification Search
USPC ..... 473/282, 131, 329
See application file for complete search history.

(56) References Cited

U.S. PATENT DOCUMENTS 3,259,387 A * 7/1966 Beigay ..... 473/174
5,522,594 A * 6/1996 Taylor et al. ..... 473/131
5,816,927 A * 10/1998 Taylor ..... 473/131
5,860,869 A * 1/1999 Duncalf ..... 473/131
5,924,932 A * 7/1999 Taylor ..... 473/131
6,139,440 A * 10/2000 Taylor ..... 473/131
6,872,148 B2 * 3/2005 Lee ..... 473/131

* cited by examiner

*Primary Examiner* — Stephen L. Blau

(57) ABSTRACT

A unique quiet reliable golf club having a Clean Burning Vortex Generator capable of varying the degree of kinetic energy applied to driving a golf ball in a linear fashion, without swinging the club. The striker piston and cylinder are disposed within the golf club head casting that contains a silencing chamber to lower the db output level. The striker piston is propelled outward by a firing mechanism releasing kinetic energy to fire a cartridge. The cartridge injects burning gas pressure into a vortex generator, located at the breech end of the cylinder. The vortex generator eliminates unburned gas and disperses the gas according to a desired distance setting of a ball travel distance scale. The one piece striker piston is sealed with a piston ring and is movable on a hard-coat cylinder-bearing surface that eliminates lubrication for the purpose of driving a golf ball in a new sport played by non-golfers.

16 Claims, 5 Drawing Sheets

CLEAN-BURN VORTEX GENERATOR FOR A BALLISTIC IMPELLER GOLF CLUB

BACKGROUND

1. Field of Invention

The present invention pertains to the field of golf clubs, specifically to a gas vortex generating linear adjuster for a mechanical golf club.

2. Background Art

The recreational sport played on a golf course utilizes many types of golf clubs with varying face angles. Generally golf clubs are swung in an arc starting above the users head. This creates a club face velocity that imparts kinetic energy to the ball positioned on the ground or a tee. A shorter arc traveled by the club results in the transfer of less kinetic energy thereby varying the distance the ball travels. A key element of playing the game requires' controlling the precise direction and distance the ball travels along the course of play. Many users find playing the game of golf extremely challenging or unable to participate. To that end, many prior art attempts have been submitted to overcome this problem.

Clark disclosed in U.S. Pat. No. 769,939 issued Sep. 13, 2004 a means of adding additional energy imparted to the ball by the release of energy stored in a mechanical compressed spring. Driving the ball occurs by swinging the club head in a downward arc contacting the ball thereby triggering the energy release. The practical success of this concept was limited since most of the difficulty occurred by a swing error due to a heavier club and user proficiency. Additionally the ball compression energy release, the club head mechanical spring energy release and the club head velocity kinetic energy release will not result in the sum of the three sources and thereby, not providing any improvement.

Celestin discloses in French Pat. No. 1,181,539 issued Jun. 15, 1959 a golf club that uses an explosive charge to add additional energy to the club head velocity created by the user swinging the club. The club design apparatus being heavier is likely to cause an errant swing failing to trigger the device. Improved performance in driving the ball would be poor because the compressed energy in the ball would not occur at the precise instant the explosive charge occurred.

U.S. Pat. No. 4,170,357 issued Oct. 9, 1979 to Greer also employs an explosive charge designed to add kinetic energy to a golf ball when detonated by a swinging motion of a club face. This approach is not helpful for the same reason as that of a patent by Clark. Swinging a club with the added weight and hitting a sweet spot detonator to add explosive energy to a ball being compressed with kinetic energy is extremely difficult. The stored energy sources will not release simultaneously, thereby failing to solve the problem. The preceding patents require the user to swing a club, which is difficult even under conventional circumstances by a proficient user. Therefore the very problem the patents attempt to address and improve is defeated by the very means utilized.

The prior art issued Jun. 4, 1996 to Taylor et al discloses in U.S. Pat. No. 5,522,594 a golf club designed to impart kinetic energy upon a ball without swinging a club. Instead it is placed in a static position adjacent to a ball waiting for an impact by a striker plate being actuated by an explosive charge. The Taylor invention includes a hollow head containing a piston attached to the shaft portion of an external strike plate that seats into a recess in the retracted position. A rod is guided in and out of the hollow head through a bushing-bearing located on the clubface. The explosive charge contained in a cartridge holder fitted into a slot that positioned the active cartridge above an orifice in the holler head. A handle with a holler shaft that contains a trigger device with a firing, pin rod extended into the holler head designed to fire a cartridge releasing high-pressure gas into a holler head when the user actuates the trigger, thereby imparting kinetic energy upon the ball.

There were many problems with the Taylor invention that resulted in poor performance. The tremendous force caused the strike plate return spring to deform and the piston to detach from the rod of the strike plate. The high pressure gas failed to burn completely leaving a residue that caused the piston to jam after a few cycles. The bushing bearing used could not be lubricated since lubrication jells when combined with burned powder. The hollow head being made of aluminum failed to withstand the wear factor. The cartridge holder being shaped with a flat surface failed to maintain an adequate seal thereby releasing high-pressure gas, thereby reducing the kinetic energy produced. Aside from the poor performance there were no means to adjust the ball travel distance.

Another prior art issued Oct. 6, 1998 Taylor attempt in U.S. Pat. No. 5,816,927 failed to achieve a clean complete powder burn resulting in parts jamming. Attempt made to adjust the distance of the ball travel failed because most of the high-pressure impulse of energy was dissipated on the top of the piston before reaching the port designed to decrease the pressure. This invention provided a hollow head fitted with an internal cylinder containing a piston and rod attached to an external strike plate. This patent did not address the piston rod bearing lubrication problem. The means taught by Taylor, failed to change the distance the ball would travel in any fashion. The high-pressure cartridges were contained in ducts around a wheel circumference and fired by a firing pin protruding through a hollow shaft into the head assembly. The fired cartridges discharged into the center of the wheel, thereby passing through an injection port in the cylinder. The cone shaped center of the cartridge wheel fail to maintain an adequate seal, thereby allowing high-pressure gas to enter the adjacent cartridge ducts causing failure. The huge amount of volume between the top of the piston and the top of the cylinder created a premature drop in pressure thereby causing an incomplete powder burn which fouled the piston after a few cycles of operation. The retractor means design attempt failed to retract the piston because the pressure volume required for the retracting action did not exist. The attempted buffer spring failed to be reliable. The head casting structure proved to be impractical, costly and difficult to manufacture. Also the associated parts failed to withstand the dynamic operating pressures involved, namely the retraction concept, the tilt safety proved to be costly and impractical.

SUMMARY OF THE INVENTION

The present invention features a golf club head with an attached handle assembly, designed to impart kinetic energy on to a golf ball without swinging the club. The kinetic energy is developed by burning high-pressure gas and is adjustable in a linear fashion thereby, driving a golf ball along a course of play from a short distance, up to the distance of that of conventional clubs. The club head contains a cylinder and silencing chamber with an injection port positioned at one end of the cylinder and directly over the vortex generator armature. The linear distance adjustment is accomplished by means of a vortex-generating armature that eliminates unburned powder and directionally disperses the high-pressure gas. The vortex-generating armature core contains a series of specially designed orifices that allow the high-pressure gas to flow in the exact proportion toward the piston and or the silencing chamber thereby, controlling the amount of kinetic energy applied to the ball.

A critical element of this invention is the unique vortex-generator chamber design, containing exact dimensions and shape. The burning powder from the injection port flows in such a manner, where the shape of the vortex-generator chamber creates a complete burn, regardless of the adjuster setting. Another feature of this invention eliminates a piston, rod, bearing and strike plate assembly, which are prone to failure.

They are replaced with a slotted especially hardened one piece, striker piston, that is moveable inside the diameter of the cylinder. The cylinder walls function as a bearing surface thereby, eliminating a conventional bearing and the need for lubrication. The slotted striker piston contains a urethane spring located in the piston end of the slot that seats against a limit stop pin after the high-pressure discharge. This absorbs the energy and acts as a slotted striker piston brake at the end of the cycle. Other functions of the stop limit pin allows for quick removal, for cleaning and the pin also retains the cylinder to the club head casting. This invention uses a cartridge strip containing a series of cartridges, where a spring-loaded hold-down firing pin assembly seats each cartridge into a firing port. In the head casting, there is a shock reliever ring system to absorb the tremendous shock wave that develops after the high-pressure discharge. The upper portion of the handle grip contains a sleeve connected to a linkage rod that continues through a hollow shaft and firing pin spring, which stores kinetic energy when the sleeve is actuated. The handle portion contains the firing trigger and safety controls that release the kinetic energy, needed to penetrate the rim fire cartridge.

OBJECTS AND ADVANTAGES

Besides the objectives and advantages described above, to be more specific the objectives advantages of the present invention are:

(a) To provide a unique low cost quiet golf club that is safe, operational, easy to use and easy to manufacture.

(b) To provide a unique golf club containing an absolute clean burning vortex generator, imperative to controlling the linear distance a golf ball travels.

(c) To provide a unique golf club capable of hitting golf balls multiple distances without fouling or jamming.

(d) To provide a unique golf club containing a striker piston made of solid construction.

(e) To provide a unique golf club striker piston design, not requiring a shaft bearing and not requiring lubrication.

(f) To provide a unique golf club striker piston containing a urethane brake.

(g) To provide a unique golf club striker piston containing a hard anodized coating.

(h) To provide a unique golf club embodiment made of aluminum, cast in one piece construction.

(i) To provide a unique golf club that uses existing cartridge strips made by Winchester Industrial Products Company.

(j) To provide a unique golf club containing a safe spring loaded cartridge hold down lever.

(k) To provide a unique golf club containing an easy to read, ball travel distance indicator.

(l) To provide a unique golf club containing an in shaft mounted firing pin spring.

(m) To provide a unique golf club containing an easy to assemble handle assembly.

(n) To provide a unique golf club containing a cylinder made of 17-4 stainless steel other hard material.

(o) To provide a unique golf club containing a removable through stop pin that allows for easy cleaning.

(p) To provide a unique golf club containing a recoil shock wave reliever means.

DRAWING FIGURES

REFERENCE NUMERALS IN DRAWING

Figure 2:
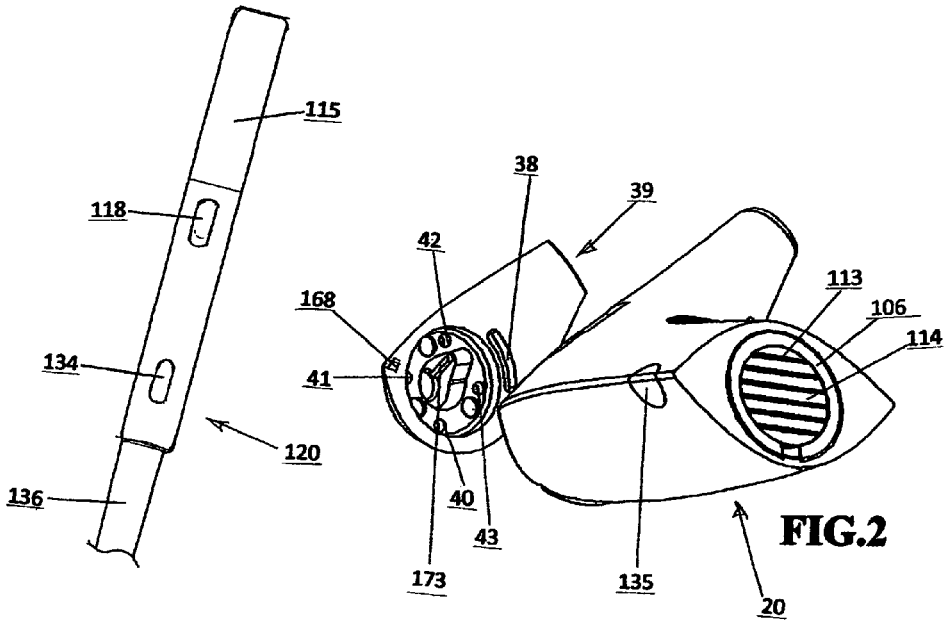
FIG. 2 shows a perspective partial exploded view of a golf club head.

20 golf club head casting
21 firing pin
22 left side head casting stop pin hole
23 firing pin return spring
24 stop pin retaining screw hole
25 cylinder
26 stop pin
27 spring loaded hold bar
28 left side stop pin profile
29 ball travel distance scale
30 cartridge hold down head casting handle
31 exit breech cartridge clearance tray
32 cartridge hold down head casting hinge pin
33 cartridge hold down head casting hinge pin boss
34 cartridge hold down head casting
35 golf club handle coupling retainer screw hole
36 stop pin retaining screw
37 firing pin housing
38 distance adjuster lever limit groove
39 distance adjuster indicator lever
40, 41, 42, 43 distance adjuster lever mounting screw hole
44 breech compartment
45 spring loaded hold down bar hinge pin hole
46 handle coupling mounting hole
47 spring loaded hold down hinge pin
48 cartridge hold down head casting hinge pin hole
49 spring loaded hold down bar head casting hinge pin hole
50 distance adjuster shaft key
51, 52, 53, 54 distance adjuster lever mounting screw
55 shock reliever ring
56 shock reliever wave spring
57 cylinder retainer ring
58 distance adjuster thrust washer
59 distance adjuster retaining nut
60 distance adjuster lock nut

61 spring loaded hold down bar adjustable seat
62 distance adjuster shaft mounting threads
64 distance adjuster shaft "0" ring seat
67 vortex armature collector
68 golf club head casting silencing chamber
69 distance adjuster vortex-generator shaft
70 cylinder stem hole
71 vortex armature stem key slot
72, 73, 74 75, 76, 77 vortex generator armature inlet port
78 distance adjuster vortex-generator chamber housing
79 cylinder mounting thread hub
80, 81, 82, 83, 84, 85 cylinder short distance vent port
86, 87, 88, 89, 90, 91 vortex generator armature linear outlet vent port
92, 93, 94, 95, cylinder pre-exhaust port
98, 99, 100, 101, cylinder exhaust port
104 manual striker release access groove
105 left side cylinder stop pin hole
106 cylinder muzzle end
107 striker compression ring
108 piston end
109 striker piston bearing surface
110 striker piston
111 urethane spring housing
112 striker piston stop pin guide slot
113 striker face groove
114 striker face
115 cocking handle grip cover
116 lower handle grip cover
117 cocking handle sleeve
118 thumb safety slide
119 cocking handle sleeve return spring pin (handle end)
120 golf club handle assembly
121 firing pin linkage rod guide pin
122 cocking handle return spring
123 handle frame
124 firing pin linkage rod cocking pawl
125 cocking handle retaining clip
126 firing pin linkage rod
127 firing pin spring retaining ring
128 trigger latching ring
129 cocking sleeve return spring pin (sleeve end)
130 thumb safety slide return spring
131 firing trigger housing slot
132 firing trigger return spring
133 thumb safety slide bridge retainer
134 firing trigger
135 thumb safety slide housing slot
136 main golf club shaft
137 firing pin linkage rod housing slot
138 firing pin spring
139 golf club handle shaft mounting screw hole
140 golf club handle frame shaft mounting screw hole
141 firing pin linkage rod groove
142 firing pin hammer
143 golf club shaft mounting screw
144 firing trigger hinge pin
145 right side cylinder stop pin hole
146 shaft head coupling
147 rim fire cartridge
148 cartridge container plastic strip
149 cartridge sealing cone
150 handle frame hub
151 thumb safety slide spring hole
152 cylinder inlet port
153 stop pin right end profile
154 vortex chamber
155 urethane spring
156 golf club head casting bore
157 forward cylinder "O" ring groove
158 rear cylinder "O" ring
159 right side head casting stop pin hole
160, 161, 162, 163 shock reliever mounting holes
164 distance adjuster indicator limit pin
165 firing pin return spring housing
166 spring loaded hold down bar housing
167 golf club head casting cylinder retainer ring seat
170 spring-loaded hold down bar firing pin orifice
171 shaft head coupling screw
172 cartridge hold down bar adjustable seat bearing surface
173 distance adjuster indicator lever keyway
175 medallion recess
176 forward cylinder "O" ring
177 rear cylinder "O-ring groove

DESCRIPTION OF FIGS. 1-11

Figure 1:
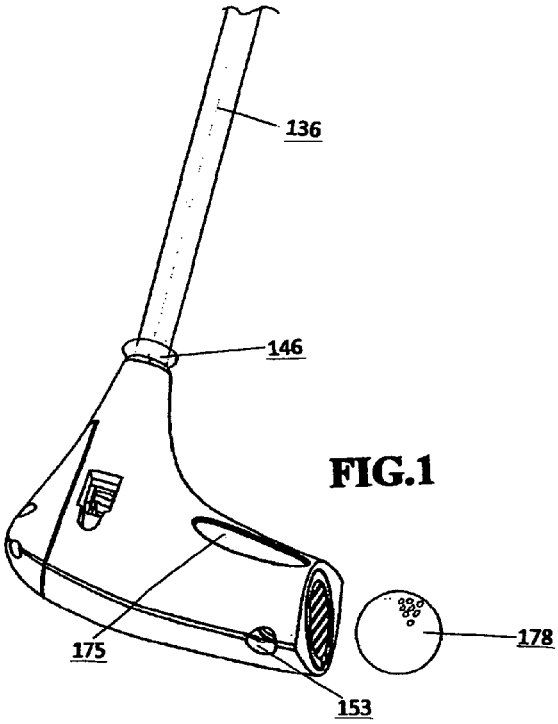
FIG. 1 shows a segmented perspective view of a golf club.
Figure 11:
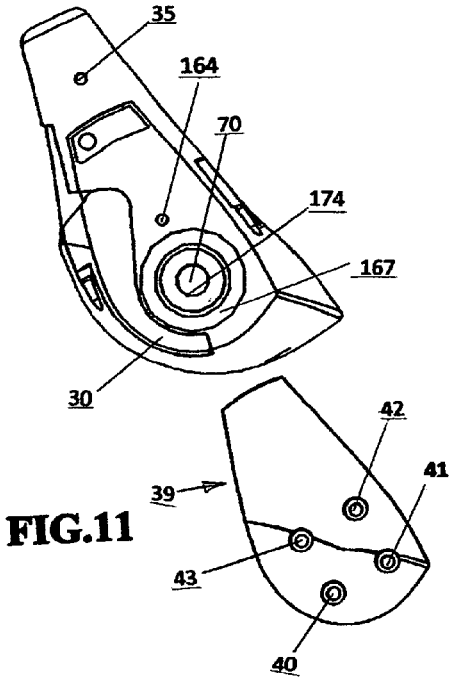
FIG. 11 shows rear view of club head with distance adjuster lever removed
Figure 3:
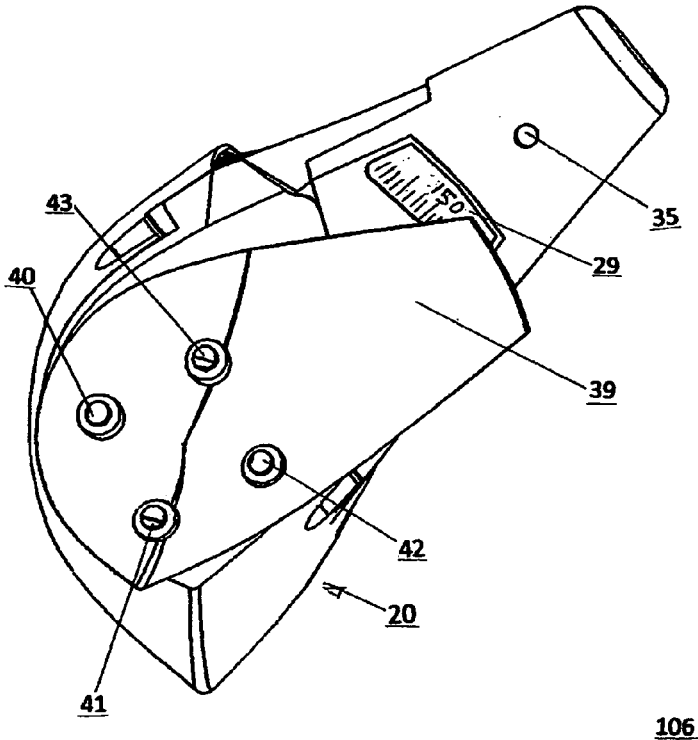
FIG. 3 shows a perspective rear view of a golf club head casting with a linear distance setting employed.
Figure 4:
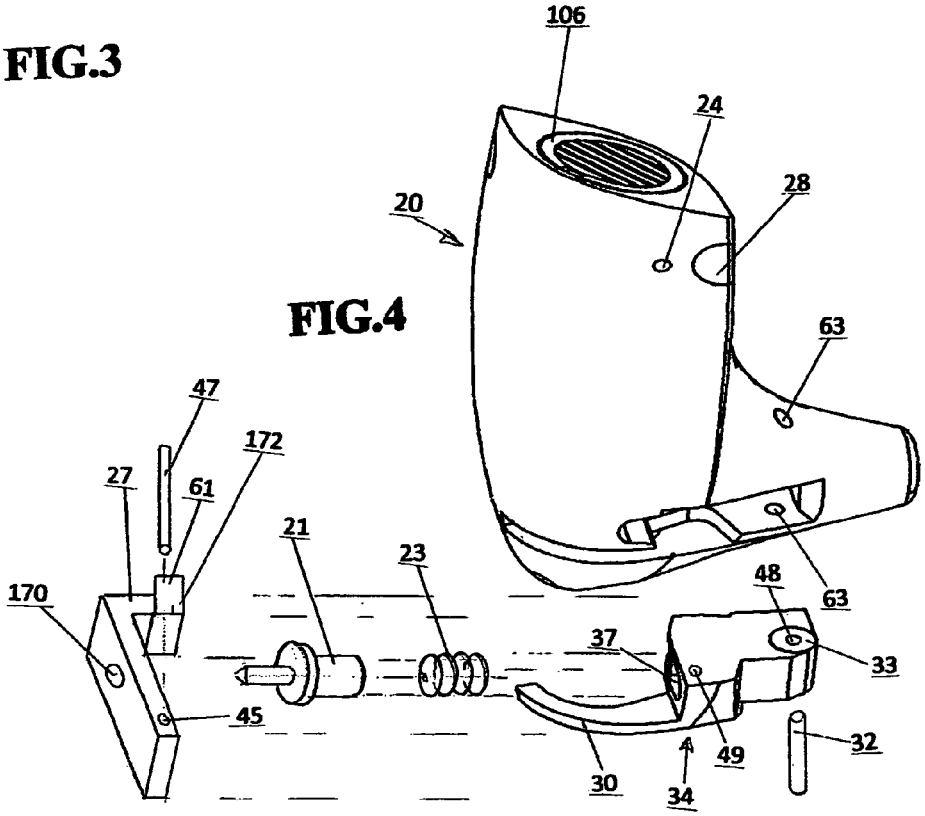
FIG. 4 shows a perspective view of a cartridge spring loaded hold down lever.
Figure 5:
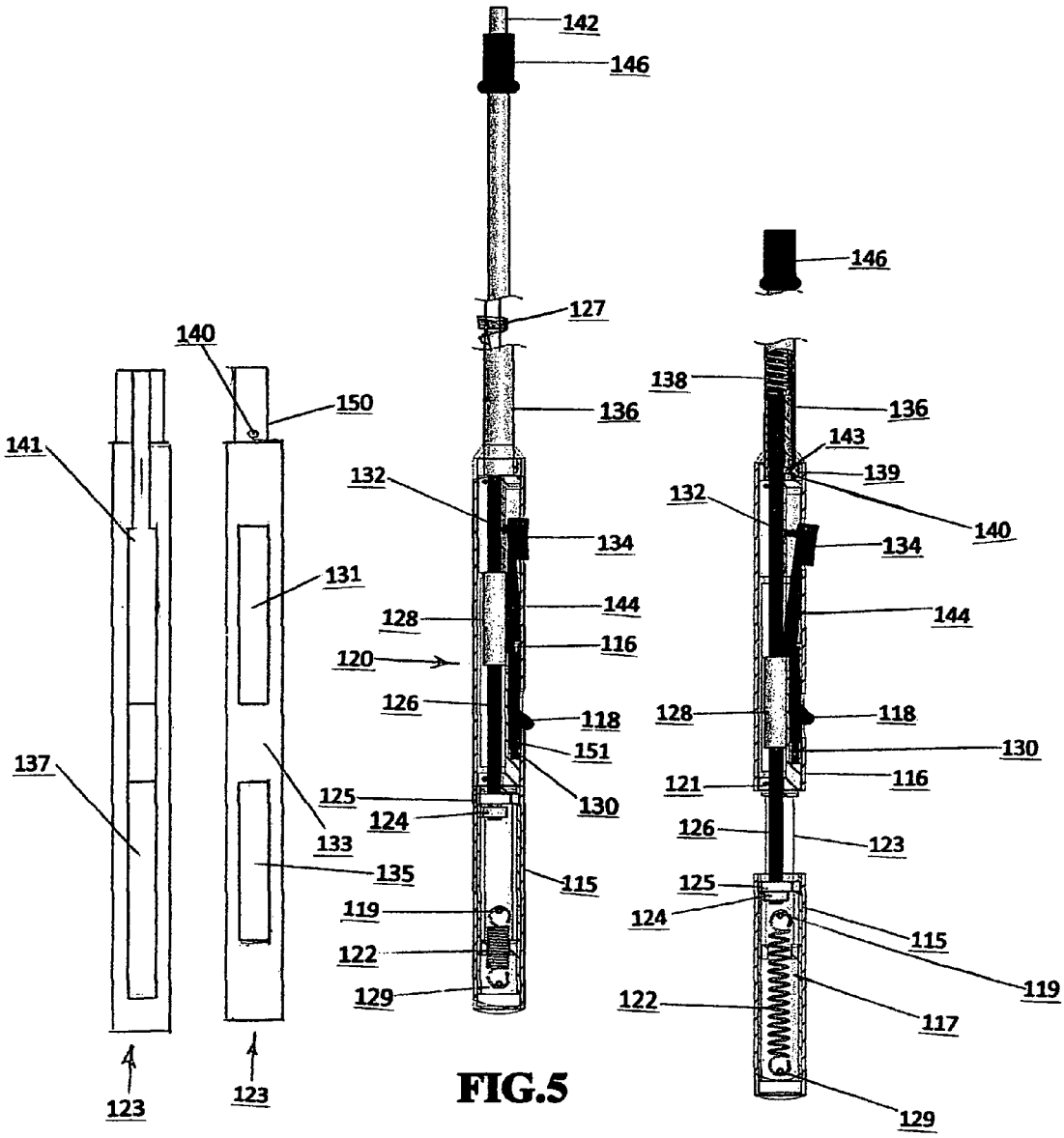
FIG. 5 shows a cutaway view of a handle and a top and bottom view of a handle frame.
Figures 6, 7, 8:
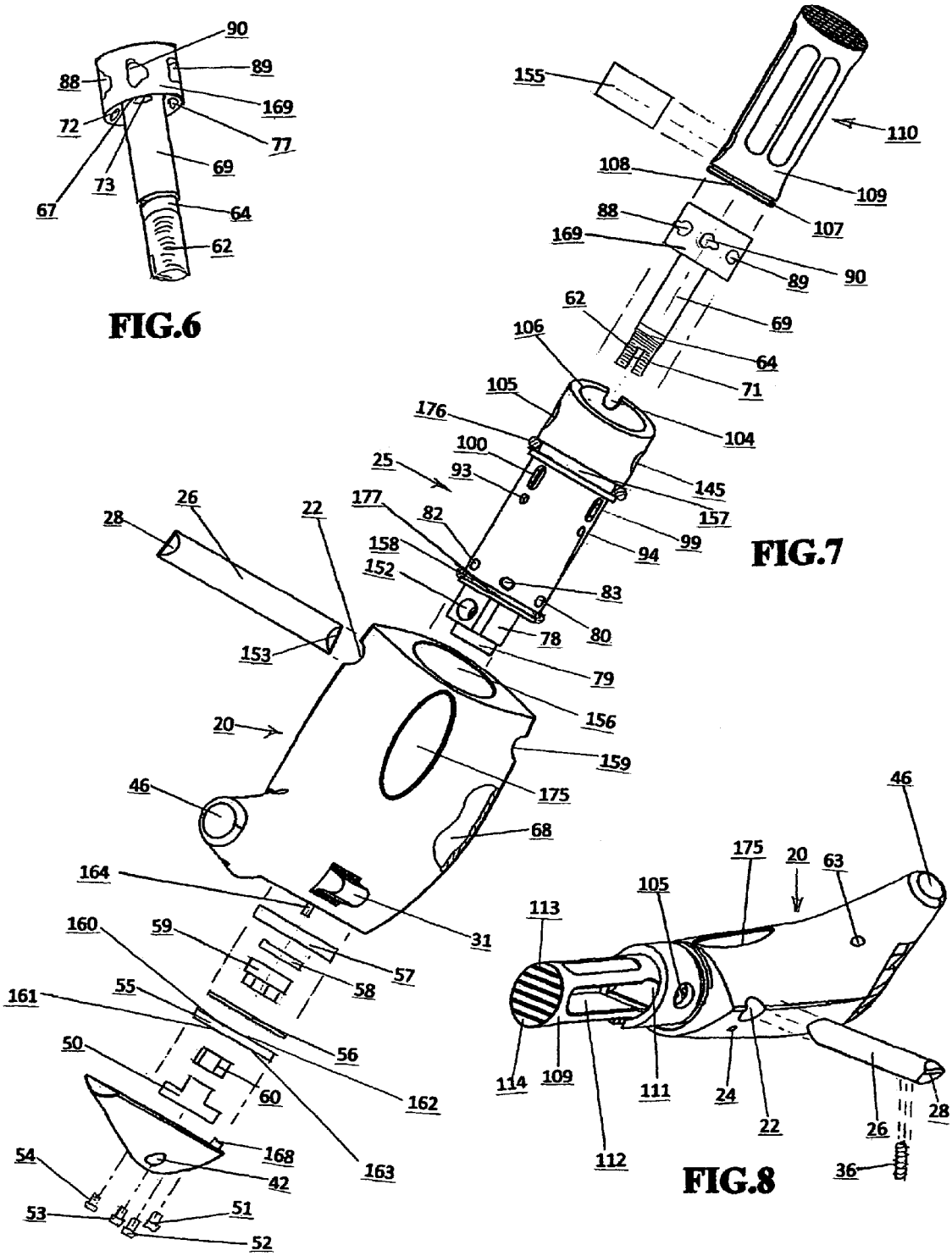
FIG. 6 shows an isometric view of a vertex generator armature.
FIG. 7 shows a top exploded view of a golf club head assembly.
FIG. 8 shows a perspective view of a partially extended cylinder and striker.
Figure 9:
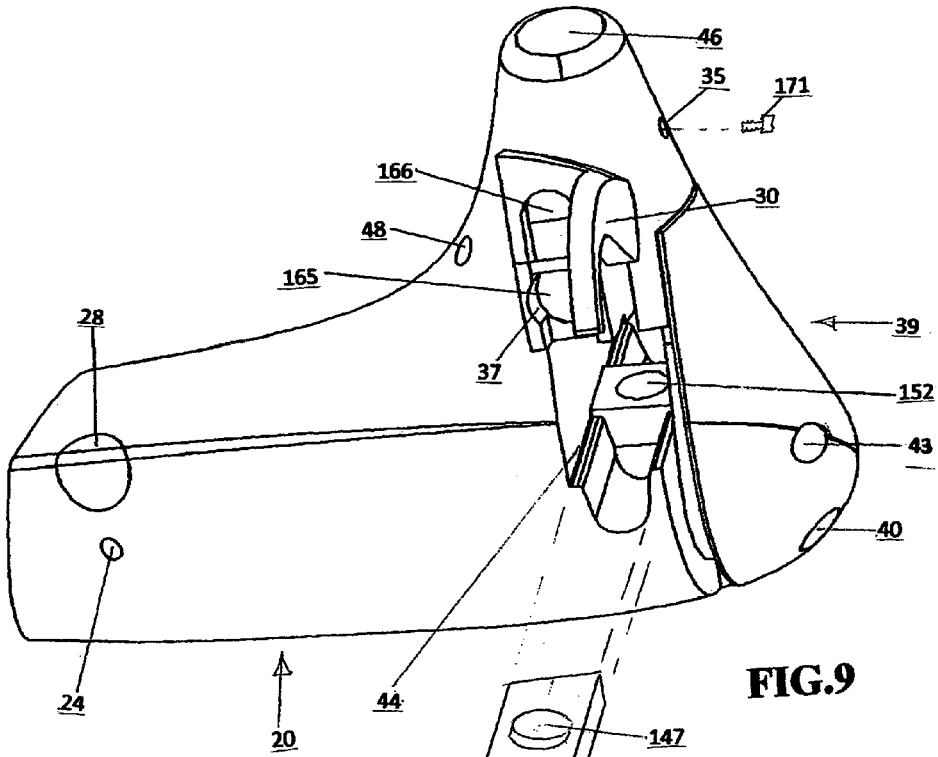
FIG. 9 shows a perspective exploded rear view of a golf head assembly with breach open in the loading configuration.

A typical golf club head casting illustrated in FIG. 1 is completely assembled ready for use. FIG. 1 through FIG. 11 clearly illustrate each component part interconnection. The head casting 20 has a cylinder 25 and muzzle end 106 containing a striker piston 114 shown in FIGS. 1, 2 and 3 in the retracted position. The striker piston 110 has an elongated slot 111 that provides a housing for a urethane spring 155. The stop pin 26 extends through golf club head casting 20 left side hole 22, through left side cylinder 25 stop pin hole 105, through striker piston 110 slot 112, through right side cylinder 25 stop pin hole 145 and through golf club head casting 20 right side hole 159 exposing stop pin 26 right end profile 153. The stop pin 26 is removable for easy cleaning by removing a stop pin retaining screw 36. Golf club head casting 20 contains a silencing chamber 68.

The side of a golf club head casting 20 has a breech compartment 44 containing a cartridge hold down casting 34. Cartridge hold down casting 34 hinges on cartridge hold down casting 34 hinge pin 32 mounted in cartridge hold down casting hinge pin hole 48 allowing breech 44 to open and close. The shaped heel of golf club head casting 20 separates from golf club 20 and becomes a distance adjuster lever indicator 39 and rotates about an axis limited by distance adjuster lever indicator 39 limit groove 38 and distance adjuster indicator limit pin 164. When distance adjuster lever indicator 39 rotates about an axis toward the end of travel of distance adjuster limit groove 38, distance adjuster indicator 39 kick-out pin 168 engages cartridge hold down casting 34 cartridge hold down handle 30. The continued rotation of distance adjuster kick-out pin 168 extracts cartridge hold down handle 30 allowing an operator to manually open breech 44, for loading cartridge container plastic strip 148 into breech compartment 44. A cartridge container strip 148 enters breech 44 with rim fire cartridge 147 sealing cone seated into cylinder 25 inlet port 152. Cartridge hold down casting 34 contains firing pin 21 and firing pin return spring 23 that rest against spring loaded hold down bar 27 and hinged by hold down bar hinge pin 47. Spring loaded hold down bar 27 is seated against cartridge plastic strip 148 by spring loaded hold down bar 27 hold down bar adjustable seat 61.

Vortex generator armature 169 seats into the combustion-end of cylinder 25 encompassed by cylinder 25 exhaust ports 80, 81, 82, 83, 84 and 85 with vortex generator shaft 69 extending through cylinder 25 stem hole 70. Vortex linear vent ports 86, 87, 88, 89, 90 and 91 seat radically against inside cylinder 25 surface and work in concert with cylinder 25 ports 80, 81, 82, 83, 84- and 85. Vortex generator stem 64 is sealed by cylinder 25 stem hole 70 "0" ring 174. Vortex generator shaft key 50 fits in Vertex generator distance adjuster shaft 39 key slot 173 and into distance adjuster indicator lever key way 176. Thrust washer 58 provides a bearing surface between cylinder 25 hub 79 and retaining nut 59 threaded on to vertex generator shaft 69 threads 62 and locked by lock nut 60 on threads 62. Shock reliever ring 55 is threaded on retaining nut 59. Shock reliever wave spring 56 applies tension between cylinder 25 retainer ring 57 and shock reliever ring 55. Cylinder 25 retainer ring 57 is threaded on to cylinder mounting thread hub 79. The distance adjuster indicator 39 is mounted to shock reliever ring 55 with distance adjuster mounting screws 51, 52, 53, and 54 are threaded into shock reliever mounting ring holes 160, 161, 162 and 163. Cylinder pre-exhaust ports 92, 93, 94, 95, and cylinder exhaust ports 98, 99, 100, 101 are closed off by striker piston bearing surface 109 in the retracted position. Cylinder forward and rear "0" rings 176 and 158 seats in cylinder "0" ring grooves 157 and 177. The cylinder "0" rings 176 and 158 seat against golf club head casting 20 bore 156. The golf club handle assembly 120 contains an upper cocking handle grip cover 115 and lower handle grip cover 116. The lower section of golf club handle 120 contains a firing trigger 134 located in the forward end of lower handle grip 116 and the thumb safety slide 118 toward the rear of lower grip 116. The golf club handle assembly 120 is coupled to a golf club head casting 20 by shaft head coupling 146 mated into handle coupling mounting hole 46 and retained by golf club handle retaining screw 171. The main golf club shaft 136 is mounted to a handle frame hub 150 and retained by golf club shaft mounting screw 143 through shaft mounting screw hole 139 threaded into handle frame screw hole 140. The firing trigger 134 pivots on firing trigger hinge pin 144 in and out of firing trigger housing slot 131. In the center section of handle frame 123 a bridge retainer 133 is formed between firing trigger housing slot 131 and thumb safety slide housing slot 135. The end of thumb safety slide 118 slides under bridge retainer 133. Thumb safety slide 118 is a moving part, sliding in thumb safety housing slot 135. The end of thumb safety slide 118 is forced forward by a spring 130 protruding from thumb safety slide spring hole 151. The opposite end of spring 130 is compressed against the end of thumb safety slide housing slot 135. The bottom side of handle frame 123 provides a firing pin linkage rod housing slot 137 sized to accommodate trigger latching ring 128 and firing pin cocking pawl 124. The forward end of handle frame 123 provides a firing pin linkage rod groove 141 to contain firing pin linkage rod 126.

The slotted smaller diameter of the rear section of handle frame 123 contains a movable handle cocking sleeve 117. Cocking handle retaining clip 125 retains the forward end of cocking handle sleeve 117. The opposite end of cocking handle sleeve 117 provides a cocking handle return spring pin sleeve end 129 and the upper end of handle frame 123 provides a cocking handle return spring pin, handle end, 119. One end of cocking handle return spring 122 is connected to cocking handle return spring pin 129 and to opposite end of cocking handle spring 122 is connected to cocking handle return spring pin, handle end 119. Firing pin linkage rod 126 extends from handle frame 123 through main golf club shaft 136 and firing pin spring 138 to golf club head 20. Firing pin spring 138 is retained on firing pin linkage rod 126 by firing pin retaining ring 127. Firing pin linkage rod 126 has a firing pin hammer 142 attached to the lower end.

OPERATION OF FIGS. 2-11

With the golf club illustrated in FIG. 1 sitting in an upright position the user pulls the upper grip 115 section of golf club handle 120 in an upward direction. Cocking handle retaining clip 125 engages a firing pin cocking pawl 124 attached to firing pin linkage rod 126 compressing a firing pin spring 138. The lower section of the golf club handle 120 contains a firing trigger 134 and a firing trigger return spring 132. Firing pin return spring 132 forces the opposite end of firing trigger 134 to engage a trigger-latching ring 128 after it traveled upward, clearing the end of firing trigger 134. The downward movement of the opposite end of firing trigger 134 allowed clearance between thumb safety slide 133 and firing trigger 134 for thumb safety slide 118 to move over the end of firing trigger 134. The preceding steps ready the golf club for loading cartridge container plastic strip 148.

To load the golf club the user places the golf club handle 120 in a horizontal position with striker piston 110 pointed downward. The user places golf club handle 120 under the left arm and with the golf club head casting 20 being held in the left hand. The user opens the breech compartment 44 by rotating distance adjuster lever indicator 39 outward, thereby engaging and opening cartridge hold down casting handle 30. With cartridge hold down handle 30 fully open to expose cylinder port 152 this will allow cartridge container plastic strip 148 rim fire load sealing cone 149 to be placed into cylinder port 152. By rotating cartridge hold down casting 30 inward closes breach compartment 44. Spring loaded hold down bar 27 engages cartridge container plastic strip 148 thereby forcing cartridge sealing cone 149 into cylinder port 152, thereby creating a sealing action. The distance adjuster lever indicator 39 is positioned on a ball travel scale 29 to the desired range a ball is expected to travel. The golf club handle 120 is placed in an upright position with the golf club head casting adjacent to a golf ball 178. The user places both hands on golf club handle 120 in a conventional manner with the left thumb on thumb safety slide 118 and the right thumb on firing trigger 134.

Figure 10:
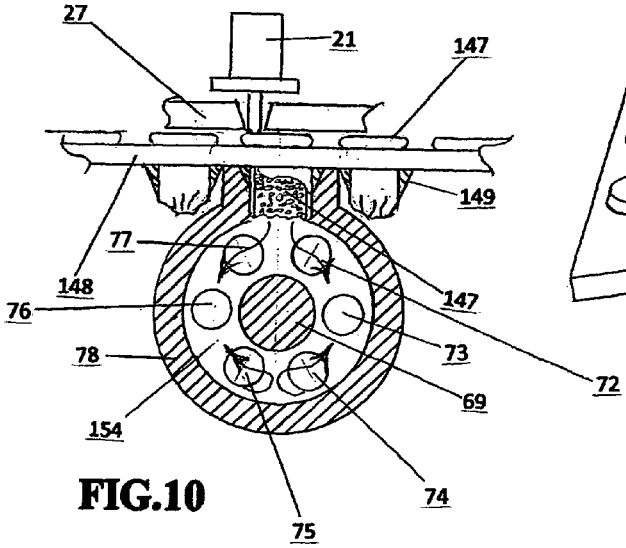
FIG. 10 shows a cutaway view a vortex generator chamber showing a critical pattern of gas flow and an end of a vortex armature.

When the user has aligned the club head casting face 114 with a golf ball 178 and directed toward the selected target, thumb safety slide 118 is pulled upward and held in position, while the firing trigger 134 is being pressed. The end of thumb safety slide 118 moves upward to clear and allow firing trigger 134 to pivot thereby releasing trigger latching ring 128. Firing pin linkage rod 126 is forced downward by kinetic energy stored in compressed firing pin spring 138. Firing pin hammer 142 moves downward and strikes firing pin 21. The pointed end of firing pin 21 penetrates rim fire cartridge 147. The rim fire primer ignites powder in rim fire cartridge 147. The initial burning powder moves the unburned granules in front of a gas flow that enters vortex chamber 154. As shown in FIG. 10, the critical shape of vortex chamber 154 establishes a gas flow pattern and vortex chamber 154 volume controls gas temperature and pressure. The gas flow enters vortex chamber 154 and is directed onto distance adjuster vortex armature shaft 69. The flow forms a vortex where unburned granules are forced to re-enter the burning granules as the gas is divided by vortex armature shaft 69. This forces the gas to meet from opposite directions, thus creating a complete burn before the gas leaves vortex chamber 154 before entering vortex armature collector 67. Refer to FIG. 10 illustrating arrows showing the vertex gas flow pattern before entering the vortex armature collector 67 further shaping the vortex flow pattern after leaving vortex generator chamber 154. Vortex armature 68 is designed to maintain the optimum temperature throughout the linear degrees of pressure change required for given distance settings. The shape and dimensions of inlet ports 72, 73, 74, 75, 76 and 77 of vortex generator armature body 68 are shown more clearly in FIG. 6.

The gas flows onto distance adjuster armature inlet collector 67 and into distance adjuster inlet ports 72, 73, 74, 75, 76 and 77.

Depending upon the position of vertex generator armature 169 the gas flow is proportionally dispersed with an exact ratio, into cylinder 25 and or into golf club head casting silencing chamber 68. This action allows the high-pressure gas to expand thereby lowering the venting velocity of the gas to an acceptable db level. The maximum distance setting on ball travel distance scale 29 allows the maximum gas flow into cylinder 25 applying full pressure to the piston end of striker piston 110. Pressure is retained on striker piston 110 by striker ring 107. Striker piston 110 slides on striker piston bearing surface 109 a given distance before exposing cylinder pre-exhaust ports 92, 93, 94, 95 and exhaust ports 98, 99, 100, 101 thereby, venting exhaust into a short distance silencing chamber 68. Depending on the position of golf club head casting 20, striker face 110 contacts a ball 178 thereby absorbing most of the kinetic energy generated by the gas pressure. The remaining kinetic energy is absorbed by urethane spring 155 becoming sandwiched between urethane housing 111 and stop pin 26. The user pulls the upper cocking handle grip cover 115 upward and manually presses the striker piston 110 to the retracted position thereby, readying the golf club for the next cycle. When firing pin hammer 142 moves upward in the cocking process firing pin 21 is retracted by firing pin return spring 23.

CONCLUSION, RAMIFICATIONS AND SCOPE OF INVENTION

The person reviewing this invention will clearly see and understand the importance for an invention to function and perform flawlessly in the market place. The scope of this invention far exceeds and improves all prior art by implementing a highly researched and developed Clean Burning Vortex Generator among other ramifications.

This invention provides higher reliability by implementing a 17-4 stainless steel or other stronger material cylinder combined with an especially hard-coated one-piece striker piston and urethane spring to solve the lubrication problem as well as elimination of structural failure. This invention contains a silencing chamber to reduce the db sound level output. Other variations are possible, such as clubs that are multi-colored, manufactured for left-handed people and people of smaller statue and with a laser direction pointer to aid the user in driving a golf ball toward a desired target.

I claim:

1. A non-conventional, ballistic impeller golf club, comprising: a one piece golf club head casting, with a center line bore containing a cylinder, whereby said casting and cylinder positioned between two "O" rings forming a silencing chamber within said golf club head casting, whereby said golf club head casting and said cylinder, are locked together by means of a through stop pin, thereby forming a rigid attachment for said cylinder, where said golf club head casting also has an attached golf club handle assembly, that provide a means for firing a rim fire cartridge selected from a plurality of cartridges contained in a plastic strip that includes a sealing means to a cylinder inlet port, located at the breach end of said cylinder, where said cylinder comprises, a vortex generator, that directs an expanding gas flow from said cylinder inlet port, into a plurality of vortex generator armature inlet ports, thereby providing a means to vary the distance a golf ball will travel, as well as effectively burning unburned powder granules expelled by said rim fire cartridge, eliminating, powder residue, from forming on a solid constructed one piece bearing-less said striker piston contained in said cylinder, restrained by a urethane spring, acting as a brake, riding in a urethane spring housing of said striker piston, providing a means to absorb the excess kinetic energy after striking said golf ball.

2. The golf club as recited in claim 1 contains said one piece striker piston, which is retained in said cylinder and functions by providing a means, for converting propellant energy into said kinetic energy, whereby said stop pin limits said striker piston at the end of the striker piston travel.

3. The golf club as recited in claim 1 employs said one piece bearing-less striker piston, mated inside said cylinder with a slide fit tolerance riding on a hard anodized Teflon impregnated coating where the Teflon performs as a lubrication for said cylinder wall bearing surface.

4. The golf club as recited in claim 1 further including a floating urethane spring, riding in a urethane spring housing, of said striker piston stop pin guide slot, providing a means for deceleration and a brake for said striker piston, whereby said urethane spring brake action occurs by said urethane spring being sandwiched between said stop pin and the inside of said striker piston urethane spring housing.

5. The golf club as recited in claim 1 comprises said vortex generator disposed underneath said inlet port of said cylinder, which has a vortex generator armature containing said plurality of inlet ports and a plurality of cylinder short distance vent ports that work in concert to provide a means to direct the gas flow pressure against the striker piston, or by pass said pressure into said golf club head casting silencing chamber.

6. The golf club as recited in claim 1 further including a floating urethane spring riding in said urethane spring housing of said striker piston providing a means for deceleration and said brake for said piston.

7. The golf club as recited in claim 1 further including said one piece golf club head casting, thereby providing a housing means for said cylinder, said cartridge container plastic strip, a cartridge hold down assembly and said golf club handle assembly.

8. The golf club as recited in claim 7 further including said cartridge container plastic strip, which contains said plurality of said rim fire cartridges that provide said expanding gas flow pressure to accelerate said striker piston.

9. The golf club as recited in claim 1 wherein said cartridge container plastic strip is held in position by a spring loaded hold down bar, which provide a mechanical sealing force being applied to said cartridge container plastic strip, thereby allowing a cartridge sealing cone to seal into said cylinder inlet port.

10. The golf club as recited in claim 1 further including a ball travel distance scale, which provides a means to indicate the distance said golf ball will be propelled, by rotating said vortex generator armature, by means of a distance adjuster indicator lever.

11. The golf club as recited in claim 1 wherein includes a shock reliever ring and retaining means for said distance adjuster indicator lever.

12. The golf club as recited in claim 1 wherein includes said golf club handle assembly containing a hollow shaft that house a firing pin spring, a firing pin rod, which is connected to a handle frame.

13. The golf club as recited in claim 12 further including said handle frame, that house a trigger latching ring, a firing pin cocking pawl, a firing trigger, a thumb safety slide, a cocking handle sleeve, a cocking handle return spring and an upper and lower handle grips.

14. The golf club as recited in claim 1 further including said silencing chamber, formed between the "O" ring seals mating within said golf club head casting bore, to each end of said cylinder, thereby isolating an internal cavity inside said golf club head casting, thereby forming said golf club head casting silencing chamber.

15. The golf club as recited in claim 1 further including a gas receiving multi-port in said vortex generator armature to provide a linear dispersing of said expanding gas flow through said cylinder mating ports, where the vortex generator armature rotates around a longitudinal axis connected to said distance adjuster vertex generator shaft, that extends through an "O" ring seal to said distance adjustor indicator lever, that exposes a graduated scale indicating the degree of rotation of said armature.

16. The golf club as recited in claim 1 further including the distance adjuster vortex generator shaft extending through an "O" ring seal through a cylinder stem hole, where said distance adjuster vortex generator shaft provides a threaded mounting stud for anchoring said vortex generator against a thrust bearing, onto the cylinder inlet port of said cylinder, with the distance adjuster vertex generator shaft end containing a key slot and extending into said distance adjuster indicator lever.

* * * * *